US009544680B2

(12) United States Patent
Akino

(10) Patent No.: US 9,544,680 B2
(45) **Date of Patent: *Jan. 10, 2017**

(54) BOUNDARY MICROPHONE AND BOUNDARY PLATE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/736,990

(22) Filed: Jun. 11, 2015

(65) Prior Publication Data

US 2016/0014491 A1 Jan. 14, 2016

(30) Foreign Application Priority Data

Jul. 8, 2014 (JP) ..... 2014-140295

(51) Int. Cl.
*H04R 1/08* (2006.01)
*H04R 1/32* (2006.01)

(52) U.S. Cl.
CPC ..... *H04R 1/326* (2013.01)

(58) Field of Classification Search
CPC ..... H04R 1/08; H04R 9/08; H04R 11/04; H04R 17/02; H04R 21/02; H04R 1/02; H04R 1/105
USPC ..... 381/356, 358, 361, 369
See application file for complete search history.

(56) References Cited

U.S. PATENT DOCUMENTS

| | | | | |
|---|---|---|---|---|
| 5,103,927 | A * | 4/1992 | Heavener | H04R 1/342 181/158 |
| 8,442,255 | B2 * | 5/2013 | Akino | H04R 1/086 381/122 |
| 8,885,855 | B2 * | 11/2014 | Van Dijk | H04R 1/342 381/160 |
| 2011/0170727 | A1 * | 7/2011 | Akino | H04R 3/005 381/361 |
| 2011/0182456 | A1 * | 7/2011 | Akino | H04R 1/083 381/361 |
| 2012/0099752 | A1 * | 4/2012 | Akino | H04R 1/086 381/361 |
| 2013/0039523 | A1 | 2/2013 | Van Dijk | |
| 2014/0211974 | A1 * | 7/2014 | Pielsticker | H04R 1/086 381/359 |

FOREIGN PATENT DOCUMENTS

JP H08-65786 A 3/1996

* cited by examiner

*Primary Examiner* — Suhan Ni
(74) *Attorney, Agent, or Firm* — Manabu Kanesaka

(57) ABSTRACT

A boundary microphone includes a microphone and a boundary plate on which the microphone is placed. The boundary plate includes a porous metal material of an aluminum-based metallic fiber layer clamped by an aluminum-based expanded metal and crimped thereto. The boundary plate has a characteristic of absorbing an incoming sound wave without reflecting the sound wave to the microphone, and the microphone collects a direct sound.

7 Claims, 7 Drawing Sheets

BOUNDARY MICROPHONE AND BOUNDARY PLATE

RELATED APPLICATIONS

The present application is based on, and claims priority from, Japanese Application No. JP2014-140295 filed Jul. 8, 2014, the disclosure of which is hereby incorporated by reference herein in its entirety.

BACKGROUND OF THE INVENTION

Field of the Invention

The present invention relates to a boundary microphone having a sound collecting characteristic independent from installation locations or sound collecting angles, and a boundary plate used for this boundary microphone.

Description of the Related Art

Boundary microphones (microphones for collecting sound on a plane) are often used in TV studios or at meetings. In TV studios, on stages, or in concert halls, boundary microphones are used while placed on a floor. At meetings, those microphones are used while arranged on a table.

These boundary microphones include, for example, as disclosed in Japanese Unexamined Patent Application Publication No. 8-65786 and Japanese Unexamined Patent Application Publication (Translation of PCT Application) No. 2013-527995, a boundary plate and a microphone placed thereon. Usually, the boundary plate is a plate with a flat and reflecting surface made of a metal or plastic.

Incidentally, when a microphone alone is used, direct sound as well as reflected sound (indirect sound) reach the microphone. Since the reflected sound arrives with a delay compared with the direct sound, the reflected sound interferes with the direct sound, thereby deteriorating the intelligibility of sound signals.

Meanwhile, although a boundary microphone collects direct sound and indirect sound reflected by the boundary plate, the microphone is arranged in proximity of the boundary plate, thus allowing for collecting the direct sound and the indirect sound with little difference in time.

Therefore, sound signals with high intelligibility, free from interference from the delayed reflected sound, can be obtained from the microphone. It is also known that an output sound level of the microphone can be increased since the microphone receives the direct sound as well as the indirect sound reflected by the boundary plate.

FIGS. 1 and 2 are a top view and a front view, respectively, showing a basic configuration of the aforementioned boundary microphone.

A boundary microphone 1 shown in FIGS. 1 and 2 includes a boundary plate 2 formed in a rectangular shape and, for example, a condenser microphone 3 placed thereon. The boundary plate 2 shown in this example has long sides (sides in the longitudinal direction of the condenser microphone 3) of 300 mm and short sides (sides in the direction perpendicular to the longitudinal direction) of 200 mm.

A front end of the condenser microphone 3, namely, a front acoustic terminal of the condenser microphone 3, is positioned at, for example, 80 mm from the end in the longitudinal direction of the boundary plate 2 (right-side end in FIGS. 1 and 2) and in the center part in the short side direction such that a sound collecting axis of the microphone 3 is parallel to the top surface of the boundary plate 2.

Note that, although not shown, this boundary microphone 1 including the boundary plate 2 and the condenser microphone 3 placed thereon is housed in a flat casing having a punched plate (perforated plate) covering the whole structure.

In FIG. 2, the sound collecting axis of 0° of the condenser microphone 3 as well as directions (angles) of sound sources seen from this sound collecting axis are shown. Hereinafter, based on a relationship between the condenser microphone 3 and directions (angles) of a sound source as shown in FIG. 2, respective characteristics shown in FIG. 3 and the subsequent drawings are described.

FIGS. 3A to 3C show measured results of characteristics of the unidirectional condenser microphone 3 alone when the boundary plate 2 is not used therewith. These characteristics of the microphone alone are utilized for comparison with a case where a boundary plate of the related art or a boundary plate according to an embodiment of this invention is used. Both boundary plates will be described later.

That is, FIG. 3A shows frequency characteristics expressed by the horizontal axis depicting frequency and the vertical axis depicting output level (dBV), as is well known. In FIG. 3A, symbols A, B, C, and D indicate measurement results for cases where a sound source is placed at angular positions of 0°, 90°, 180°, and 270°, respectively, relative to the sound collecting axis of the microphone 3.

Likewise, FIG. 3B shows frequency characteristics where symbols A, B, and C indicate measurement results for 0°, 30°, and 40°, respectively.

Furthermore, FIG. 3C shows a polar pattern. As shown in this polar pattern, characteristics of the exemplified condenser microphone 3 alone show general unidirectional characteristics.

Next, in FIGS. 4A to 4C, respective characteristics of the boundary microphone 1 are shown for the boundary plate 2 of the related art made of, for example, plastic and not transmitting sound waves. Dimensions of the boundary plate 2 and arrangement of the condenser microphone 3 are as exemplified in FIGS. 1 and 2.

Meanwhile, in FIG. 4A, frequency characteristics are shown where symbols A, B, C, and D indicate measurement results for angular positions of 0°, 90°, 180°, and 270°, respectively, relative to the sound collecting axis of the microphone 3. Likewise in FIG. 4B, symbols A, B, and C indicate measurement results for 0°, 30°, and 40°, respectively, and FIG. 4C shows a polar pattern.

Note that, upon measurements for FIGS. 4A to 4C, the condenser microphone 3, with which the measurement results shown in FIGS. 3A to 3C described above have been obtained, is used as the boundary microphone.

Here, when comparing a frequency characteristic at 90° indicated by symbol B in FIG. 4A and a frequency characteristic at 90° indicated by symbol B in FIG. 3A where the condenser microphone 3 alone is used, the frequency characteristic indicated by symbol B in FIG. 4A shows irregular peaks and dips for a wide range of frequency bands.

This is because the plastic boundary plate itself vibrates upon receiving sound waves from the direction perpendicular to (90°) a surface of the boundary plate 2. This free vibration of the boundary plate 2 causes phase interference of sound signals.

Also, frequency characteristics at 30° and 40° indicated by symbols B and C, respectively, in FIG. 4B show increased levels over the frequency bands of 500 Hz to 6 kHz when compared with a characteristic at 0° indicated by symbol A in FIG. 4B. The amount of increase reaches 6 dB or more.

This is because, by attaching the aforementioned plastic boundary plate 2 not transmitting sound waves, reflected waves in the frequency bands of 500 Hz to 6 kHz also reach the microphone 3, thereby increasing the levels.

In other words, sound in the aforementioned frequency bands is reproduced while stressed at an angle of 30° or 40°, providing sound signals largely different from the original sound.

Therefore, when the boundary plate of the related art made of plastic or metal and not transmitting sound waves is used, different directional frequency responses are experienced depending on installation locations of the boundary microphone, thus providing different tones depending on angles of the sound source.

For these reasons, when a microphone provided with the aforementioned boundary plate in the related art is used, for example, for collecting sounds of musical instruments, tones may vary depending on locations of the musical instruments, which is not preferable for collecting sound of good sound quality such as musical sound.

SUMMARY OF THE INVENTION

This invention is to address the aforementioned problems of the boundary microphones in the related art. An object of the invention is to provide a boundary microphone, capable of preventing occurrence of phase interference due to natural vibration of a boundary plate itself while having a sound collecting characteristic independent from installation locations or sound collecting angles, and a boundary plate used for the boundary microphone.

A boundary microphone according to an embodiment of the invention devised in order to achieve the aforementioned object includes a microphone and a boundary plate on which the microphone is placed. The boundary plate includes a porous metal material of at least an aluminum-based metallic fiber layer crimped to an aluminum-based expanded metal.

In this case, another preferred example of the boundary plate includes the porous metal material of the aluminum-based metallic fiber layer clamped by the aluminum-based expanded metal and crimped thereto. Here, a configuration is employed where the boundary plate has a characteristic of absorbing an incoming sound wave without reflecting the sound wave to the microphone, and the microphone collects a direct sound.

Meanwhile, a boundary plate used for a boundary microphone according to an embodiment of the invention has a microphone placed thereon, thereby absorbing an incoming sound wave without or substantially without reflecting the sound wave to the microphone while providing only or substantially only a direct sound to the microphone. The boundary plate includes a porous metal material of at least an aluminum-based metallic fiber layer crimped to an aluminum-based expanded metal.

Also, in the boundary plate according to an embodiment of the invention, the porous metal material of the aluminum-based metallic fiber layer clamped by the aluminum-based expanded metal and crimped thereto is suitably used.

For the boundary microphone and the boundary plate of the aforementioned configuration, the porous metal material of at least the aluminum-based metallic fiber layer crimped to the aluminum-based expanded metal or the porous metal material of the aluminum-based metallic fiber layer clamped by the aluminum-based expanded metal and crimped thereto is used.

In addition, for the boundary microphone according to an embodiment of the invention, the aluminum-based expanded metal is preferably formed in an entirely net-like shape obtained by making a number of cuts on a thin plate, and includes a twisted portion facing not only in a direction perpendicular to a surface of the thin plate but also in a parallel or a skewed direction thereto.

The boundary plate of the aforementioned porous metal material has a sound absorbing characteristic unique to porous materials and is capable of effectively suppressing reflection of sound waves. Therefore, a boundary microphone with greatly decreased angular dependence on sound waves incoming to a microphone can be provided.

Furthermore, this allows for suppressing a rise in certain frequencies due to reflection by the boundary plate, contributing to flattening of the frequency characteristic of the boundary microphone.

Moreover, the boundary plate including the aluminum-based metallic fiber layer and the aluminum-based expanded metal has also a vibration-damping property, and thus, vibration of the boundary plate itself upon receiving sound waves can be suppressed. This effectively prevents occurrence of the aforementioned phase interference due to natural vibration of the boundary plate.

DESCRIPTION OF THE PREFERRED EMBODIMENTS

Figure 1:
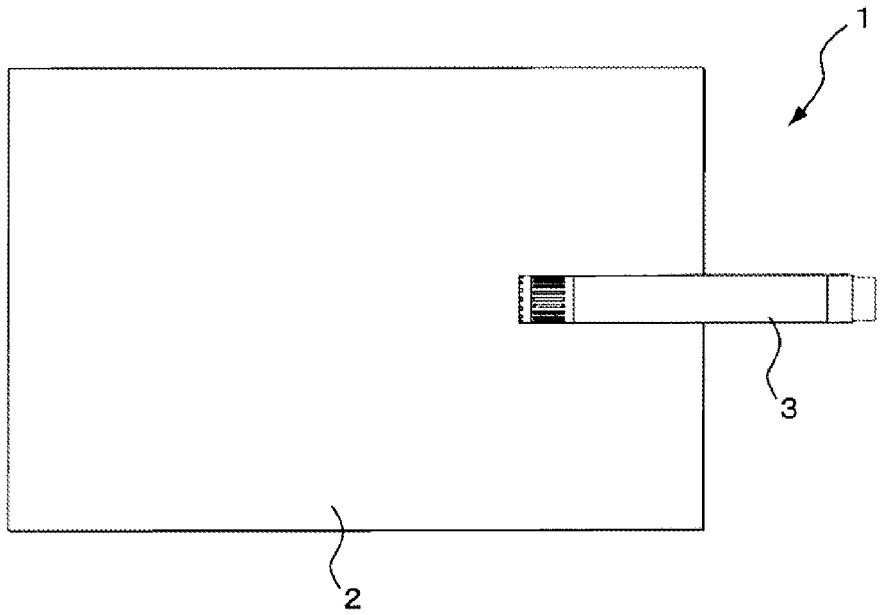
FIG. 1 is a top view showing a basic configuration of a boundary microphone.

A boundary microphone and a boundary plate of the invention will be described based on an embodiment shown in the drawings.

Figure 2:
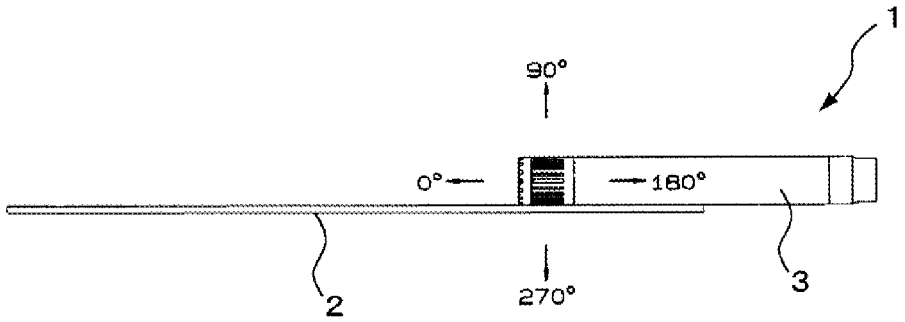
FIG. 2 is a front view of the basic configuration.

The boundary microphone according to an embodiment of the invention employs the configuration shown in FIGS. 1 and 2 as have already been described. A boundary plate 2 used for a boundary microphone 1 includes a porous metal material of at least an aluminum-based metallic fiber layer crimped to an aluminum-based expanded metal.

Figure 5:
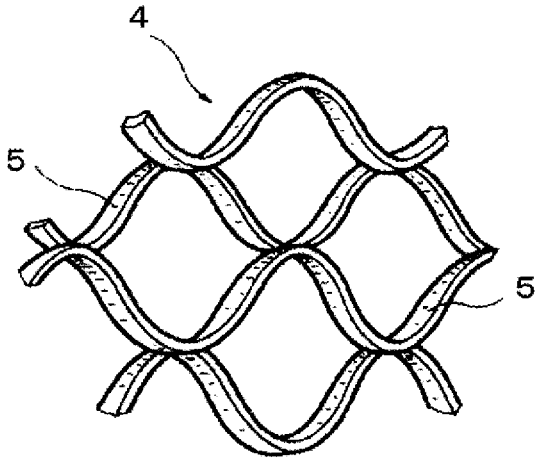
FIG. 5 is a schematic view of an expanded metal included partially in a boundary plate according to an embodiment of the invention.
Figure 6:
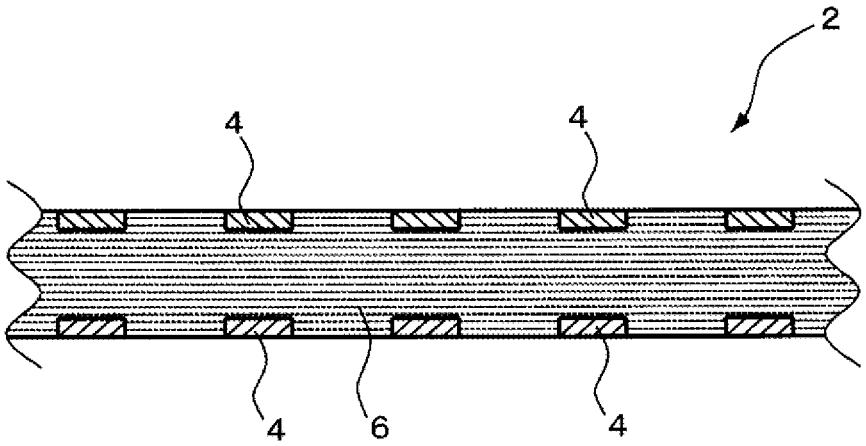
FIG. 6 is a cross-sectional view of the boundary plate according to an embodiment of the invention.

FIGS. 5 and 6 are schematic views showing a configuration of the boundary plate 2. The boundary plate 2 shown in FIGS. 5 and 6 includes a porous metal material of an aluminum-based metallic fiber layer 6 clamped by an aluminum-based expanded metal 4 and crimped thereto.

FIG. 5 shows an example of the aluminum-based expanded metal 4. This expanded metal 4 formed in an entirely net-like shape can be obtained by making a number of cuts on a thin plate made of aluminum with a thickness of 0.2 to 1 mm, and then pulling the thin plate in a direction perpendicular to the cuts.

This expanded metal 4 is not a product of weaving metal fine wires such as a metal net, and thus the cross-sections of the cuts in the aluminum thin plate are twisted by the pulling force. Therefore, the expanded metal 4 includes a twisted portion 5 facing not only in a direction perpendicular to a surface of the thin plate but also in a parallel or a skewed direction thereto.

Therefore, when the expanded metal 4 having the twisted portion 5 is pressed against the aluminum-based metallic fiber layer 6, the expanded metal 4 is preferably entangled with the metallic fiber layer 6. This characteristic of the expanded metal 4 can be utilized for formation of the porous metal material.

Meanwhile, the aluminum-based metallic fiber layer 6 includes aluminum formed in a fiber shape. A cross-section of the aluminum fiber may be round or any other shape. The aluminum fiber is a fine wire having an effective diameter of 20 to 200 μm and a length of 0.1 m or more.

The aluminum fine wire is obtained by, for example, ejecting molten aluminum from a nozzle into the air and subjecting it to rapid cooling and solidification. Therefore, like cotton fibers, the aluminum fine wires obtained here provide a non-woven fabric with a predetermined area density of the aluminum long fibers in a non-compressed state.

The expanded metal 4 as shown in FIG. 5 is arranged on both surfaces of the aluminum fiber layer 6 in the aforementioned non-woven fabric form, which is then subjected to pressing or rolling at 300 kg/cm$^2$ to 2000 kg/cm$^2$, thereby making the expanded metal 4 bite into the aluminum fiber layer 6 for adherence therebetween.

Here, by selecting a rate for pressing or rolling as appropriate, the density of the porous metal material (porosity rate) can be adjusted. This allows for provision of the porous metal material having appropriate sound-absorbing and vibration-damping characteristics.

Note that, as the aforementioned porous metal material, for example, "POAL" (trade name, manufactured by UNIX Co., Ltd. (Ota-ku, Tokyo)) can be suitably used.

FIG. 6 is a cross-sectional view of the porous metal material formed in the aforementioned manner, suitably usable as the boundary plate 2 according to an embodiment of the invention. The expanded metal 4 is closely attached to both surfaces of the aluminum fiber layer 6 by plastic deformation.

Note that, although the example shown in FIG. 6 employs a configuration where the aluminum-based metallic fiber layer 6 is clamped by the aluminum-based expanded metal 4 and crimped thereto, a porous metal material, where the expanded metal 4 is crimped to one surface of the aluminum-based metallic fiber layer 6, can also suitably be used as the boundary plate 2 according to an embodiment of the invention.

The porous metal material obtained in the aforementioned manner can be used as the boundary plate 2 by cutting the material into the form shown in FIGS. 1 and 2, as appropriate. Further placing the condenser microphone 3 on this boundary plate 2 provides the boundary microphone 1.

Figure 7A:
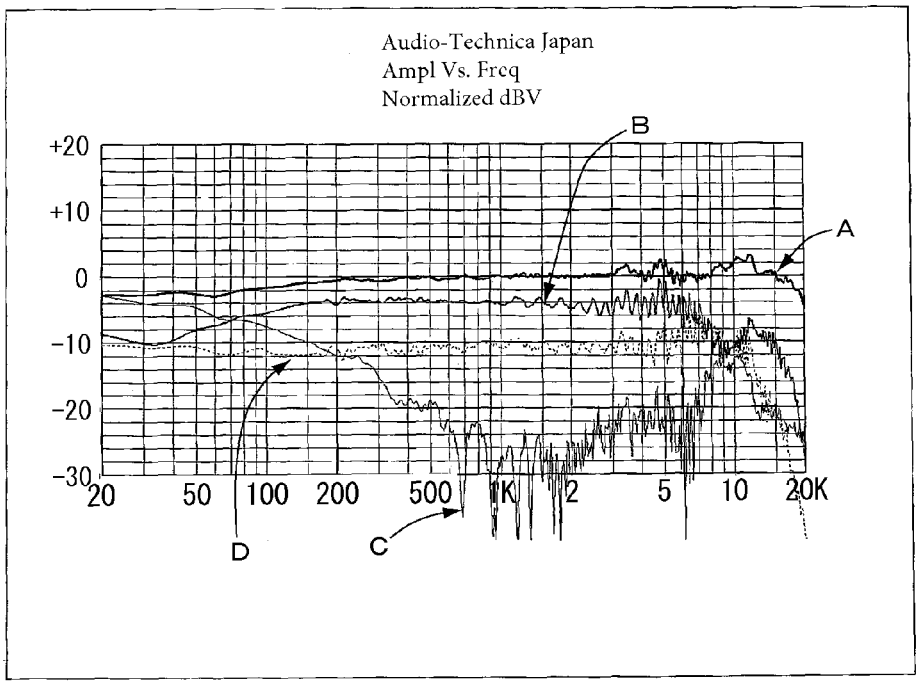
FIG. 7A is a graph of measured values showing frequency characteristics of a boundary microphone according to an embodiment of the invention.
Figure 7B:
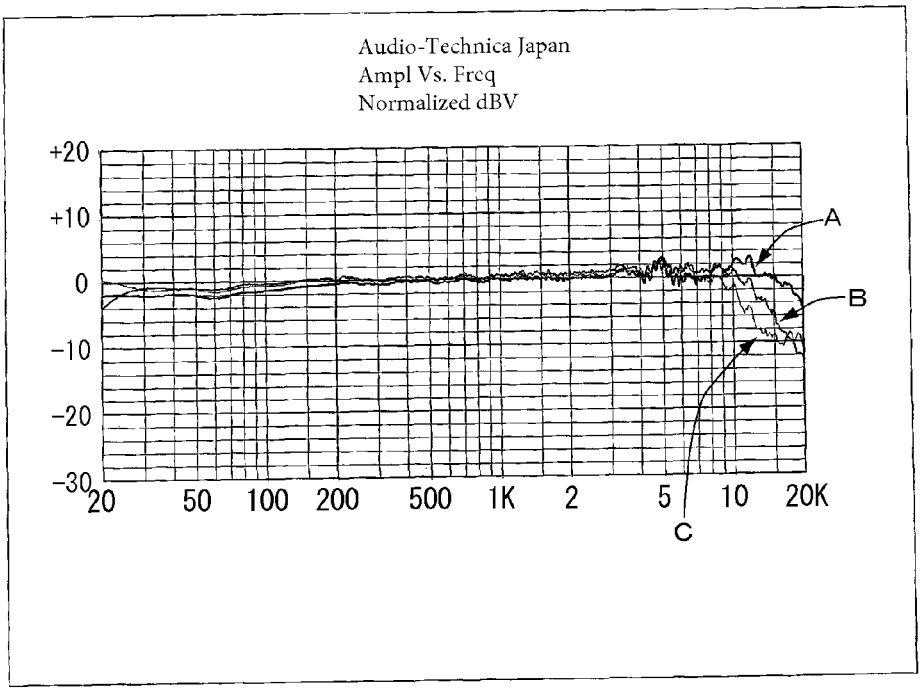
FIG. 7B is a graph of measured values showing frequency characteristics when an angular position of a sound source is changed relative to a sound collecting axis.
Figure 7C:
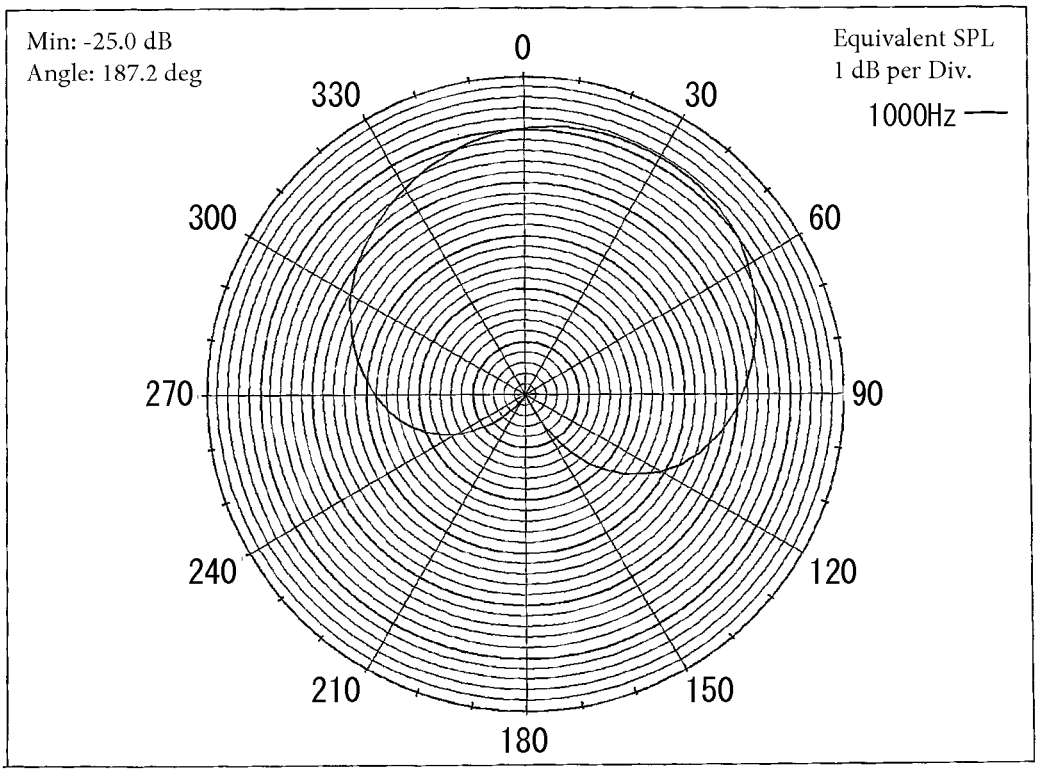
FIG. 7C is a graph of measured values of a polar pattern of the boundary microphone according to an embodiment of the invention.

FIGS. 7A to 7C show respective measurement results for the boundary microphone 1 using the boundary plate 2 having the cross-section shown in FIG. 6. Note that, dimensions of the boundary plate 2 and arrangement of the condenser microphone 3 here are as exemplified in FIGS. 1 and 2. Also, respective characteristics indicated by symbols A to D in FIG. 7A are obtained under the same condition as the measurements indicated by symbols A to D in FIG. 4A. Similarly, respective characteristics indicated by symbols A to C in FIG. 7B are obtained under the same condition as the measurements indicated by symbols A to C in FIG. 4B.

Figure 4A:
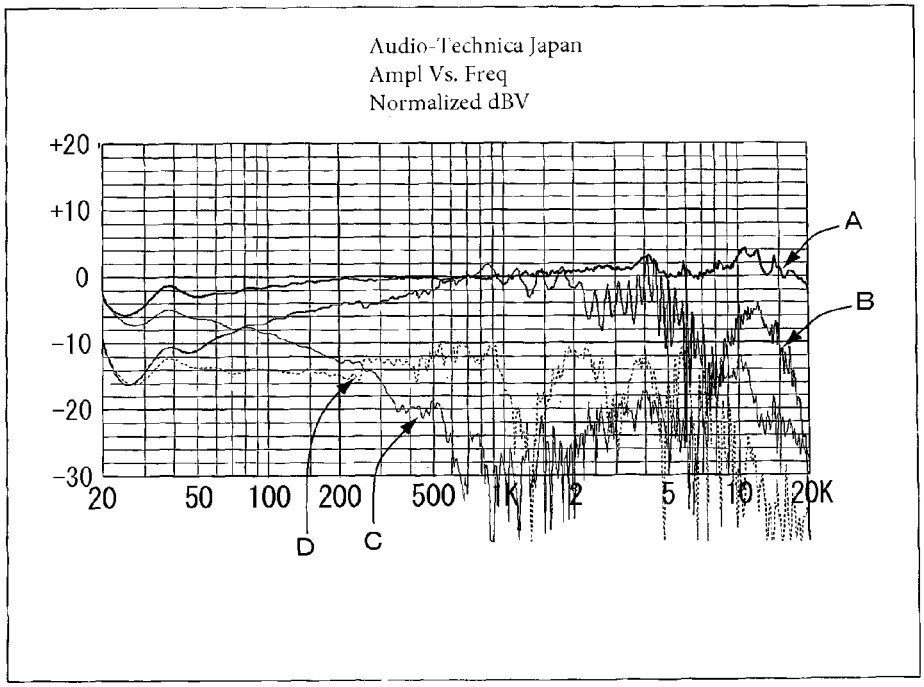
Fig. 4A Prior Art
FIG. 4A is a graph of measured values showing frequency characteristics of a boundary microphone in the related art.

When comparing a frequency characteristic where a sound source is at 90° as indicated by symbol B in FIG. 7A and a frequency characteristic where the sound source is also at 90° as indicated by symbol B in FIG. 4A, the characteristic indicated by symbol B in FIG. 7A shows that degradation of directional frequency response due to vibration of the boundary plate 2 itself is greatly reduced.

Figure 3A:
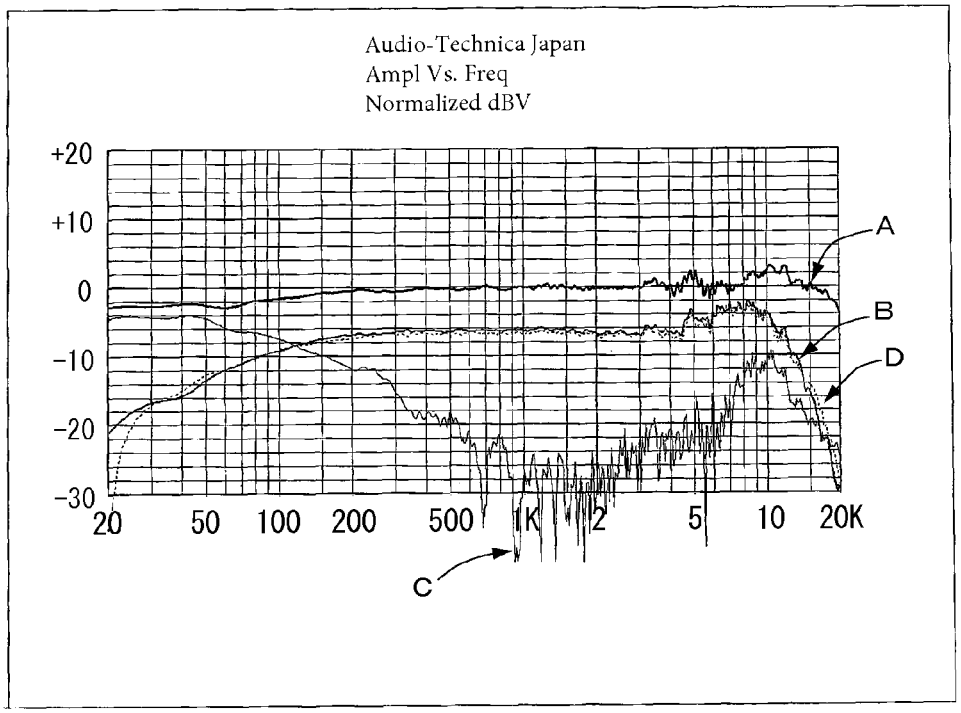
FIG. 3A is a graph of measured values showing frequency characteristics of a condenser microphone alone.
Figure 3B:
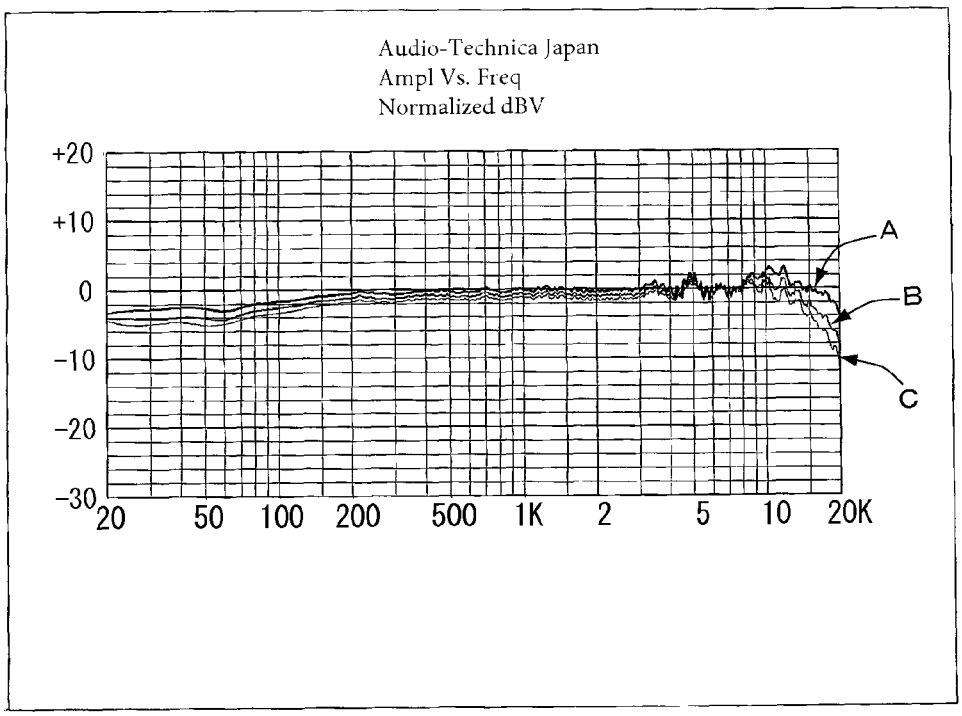
FIG. 3B is a graph of measured values showing frequency characteristics when an angular position of a sound source is changed relative to a sound collecting axis.
Figure 3C:
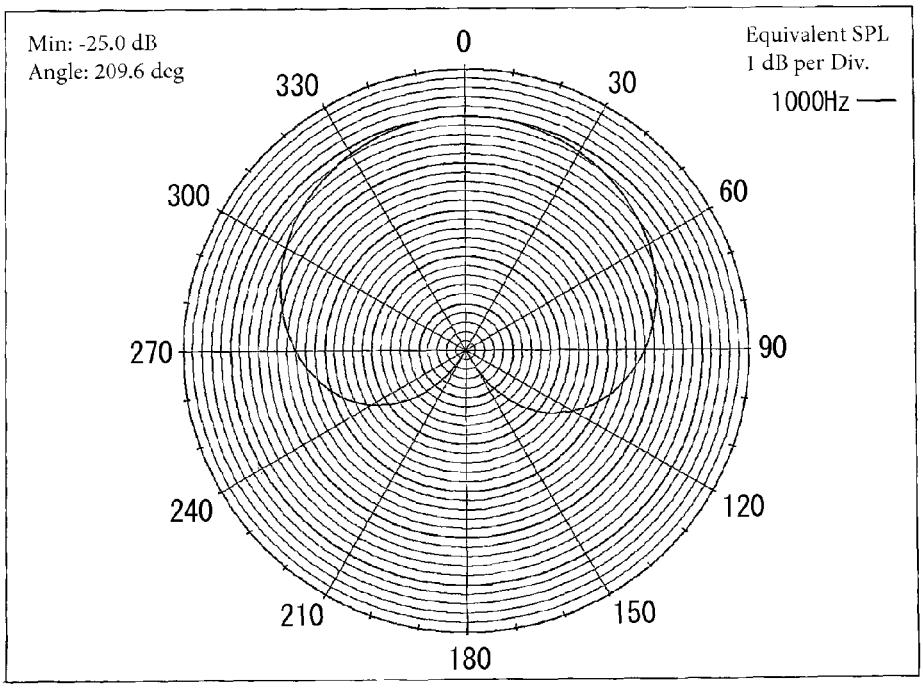
FIG. 3C is a graph of measured values of a polar pattern of the condenser microphone alone.

In other words, the characteristic indicated by symbol B in FIG. 7A is closer to the characteristic of the microphone alone as indicated by symbol B in FIG. 3A.

This results from the fact that the boundary plate 2 of the embodiment has a favorable vibration-damping property. Thus, phase interference of sound signals due to vibration of the boundary plate 2 itself is greatly reduced.

Figure 4B:
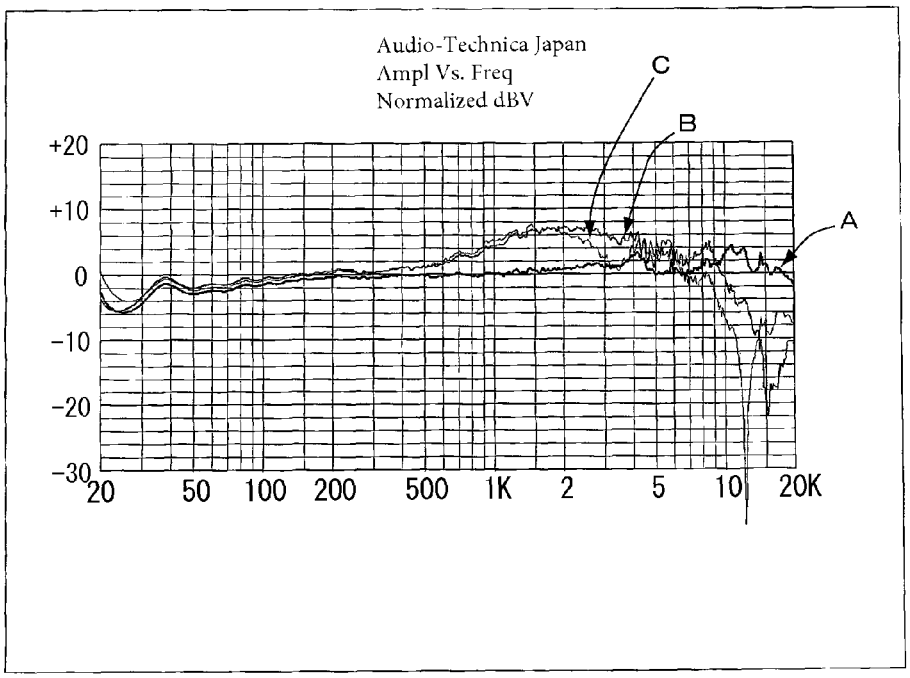
Fig. 4B Prior Art
FIG. 4B is a graph of measured values showing frequency characteristics when an angular position of a sound source is changed relative to a sound collecting axis.
Figure 4C:
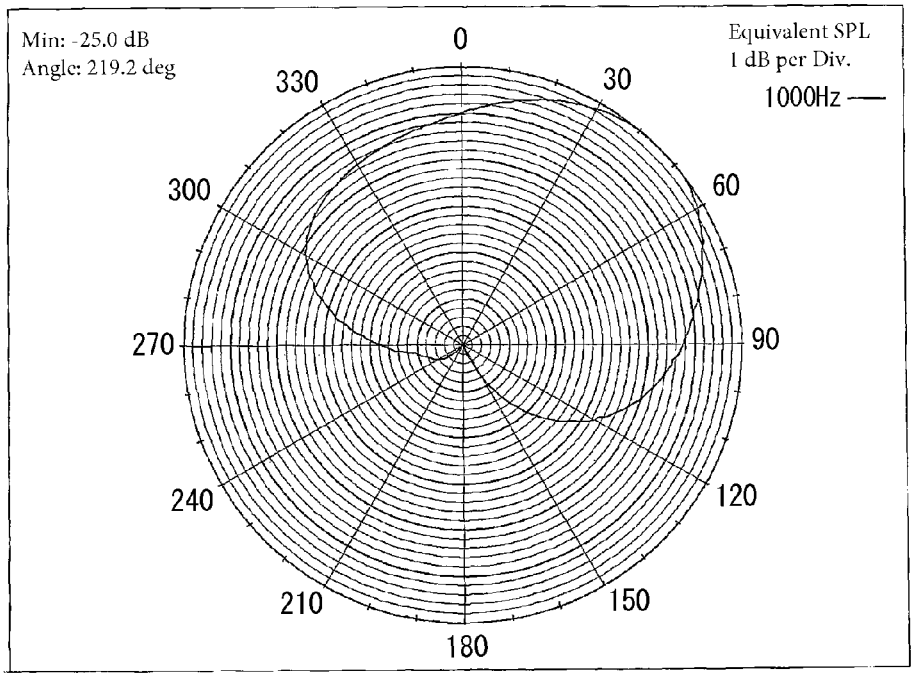
Fig. 4C Prior Art
FIG. 4C is a graph of measured values of a polar pattern of the boundary microphone in the related art.

Furthermore, frequency characteristics where the sound source is at 30° and 40°, as indicated by symbols B and C in FIG. 7B, show that the rise in levels is suppressed over the frequency bands of 500 Hz to 6 kHz, as indicated by symbols B and C in FIG. 4B.

That is, the characteristics indicated by symbols B and C in FIG. 7B show that, in the major sound collecting bands of 40 Hz to 8 kHz, the levels increase by approximately 1 to 2 dB in a uniform manner when compared with a characteristic indicated by symbol A in FIG. 7B (the characteristic where the sound source is on the sound collecting axis of the microphone).

This shows that, when compared with the boundary microphone using the plastic boundary plate in the related art that causes a rise in levels by 6 dB or more when the sound source is positioned at 30° to 40°, compared with the characteristic at the sound collecting axis (0°), the boundary microphone having less change in tones is provided even with varying sound collecting angles.

Therefore, as apparent from the results shown in FIG. 7B, usage of the boundary plate 2 including the porous metal material according to an embodiment of the invention allows for the sound collecting characteristic independent from installation locations or sound collecting angles, thereby achieving provision of the boundary microphone suitable for collecting sound of good sound quality such as musical sound.

Note that, as a matter of course, although the unidirectional condenser microphone is used as the microphone 3 in the above-described embodiment, the boundary microphone according to an embodiment of the invention may employ a microphone of a different configuration.

What is claimed is:

1. A boundary microphone comprising:

a microphone; and a boundary plate on which the microphone is placed, wherein the boundary plate includes a porous metal material of at least an aluminum-based metallic fiber layer crimped to an aluminum-based expanded metal.

2. The boundary microphone of claim 1, wherein the boundary plate includes the porous metal material of the aluminum-based metallic fiber layer clamped by the aluminum-based expanded metal and crimped thereto.

3. The boundary microphone of claim 1, wherein the boundary plate has a characteristic of absorbing an incoming sound wave without reflecting the sound wave to the microphone, and the microphone collects a direct sound.

4. The boundary microphone of claim 2, wherein the boundary plate has a characteristic of absorbing an incoming sound wave without reflecting the sound wave to the microphone, and the microphone collects a direct sound.

5. A boundary plate used for a boundary microphone, wherein the boundary plate has a microphone placed thereon, absorbs an incoming sound wave without reflecting the sound wave to the microphone, and provides a direct sound to the microphone, and the boundary plate includes a porous metal material of at least an aluminum-based metallic fiber layer crimped to an aluminum-based expanded metal.

6. The boundary plate used for a boundary microphone of claim 5, wherein the boundary plate includes the porous metal material of the aluminum-based metallic fiber layer clamped by the aluminum-based expanded metal and crimped thereto.

7. The boundary microphone of claim 1, wherein the aluminum-based expanded metal is formed in an entirely net-like shape obtained by making a number of cuts on a thin plate, and includes a twisted portion facing not only in a direction perpendicular to a surface of the thin plate but also in a parallel or a skewed direction thereto.

* * * * *